US007113144B2

(12) United States Patent
Lin et al.

(10) Patent No.: US 7,113,144 B2
(45) Date of Patent: Sep. 26, 2006

(54) ORIENTATION ADJUSTING APPARATUS FOR A SATELLITE ANTENNA SET WITH FINE TUNING UNITS

(75) Inventors: Hung-Yuan Lin, Taipei Hsien (TW); San-Yi Kuo, Taipei Hsien (TW)

(73) Assignee: Wistron Neweb Corp., Taipei Hsien (TW)

( * ) Notice: Subject to any disclaimer, the term of this patent is extended or adjusted under 35 U.S.C. 154(b) by 4 days.

(21) Appl. No.: 11/114,329

(22) Filed: Apr. 26, 2005

(65) Prior Publication Data

US 2005/0264467 A1 Dec. 1, 2005

(30) Foreign Application Priority Data

Apr. 28, 2004 (TW) ..... 93111807 A

(51) Int. Cl.
*H01Q 1/08* (2006.01)

(52) U.S. Cl. ..... 343/880; 343/882; 343/881

(58) Field of Classification Search ..... 343/880, 343/881, 882, 757, 765
See application file for complete search history.

(56) References Cited

U.S. PATENT DOCUMENTS 4,628,323 A * 12/1986 Crean ..... 343/765
5,218,975 A * 6/1993 Prostkoff ..... 128/857
6,404,400 B1 * 6/2002 Tulloch ..... 343/765
6,407,713 B1 * 6/2002 Mallenius ..... 343/765
6,657,598 B1 * 12/2003 Tulloch ..... 343/765
6,762,731 B1 * 7/2004 Chou ..... 343/882
6,932,307 B1 * 8/2005 Guennec et al. ..... 248/219.2

* cited by examiner

*Primary Examiner*—Trinh Vo Dinh
(74) *Attorney, Agent, or Firm*—Trop, Pruner & Hu, P.C.

(57) ABSTRACT

An orientation adjusting apparatus includes a support base plate set rotatable relative to a mast about a first vertical axis. An azimuth bracket is rotatable relative to the top plate of support base plate set about a second vertical axis. An elevation bracket is rotatable relative to an elevation fine tune bracket about a first horizontal axis. The elevation fine tune bracket is rotatable relative to the azimuth bracket about a second horizontal axis. An azimuth angle fine tuning unit is operable to rotate the azimuth bracket relative to the top plate of support base plate set about the second vertical axis. An elevation angle fine tuning unit is operable to rotate the elevation fine tune bracket relative to the azimuth bracket about the second horizontal axis.

20 Claims, 4 Drawing Sheets

ORIENTATION ADJUSTING APPARATUS FOR A SATELLITE ANTENNA SET WITH FINE TUNING UNITS

CROSS-REFERENCE TO RELATED APPLICATION

This application claims priority of Taiwanese Application No. 093111807, filed on Apr. 28, 2004.

BACKGROUND OF THE INVENTION

1. Field of the Invention

This invention relates to an orientation adjusting apparatus, and more particularly to an orientation adjusting apparatus for a satellite antenna set, which can fine tune the azimuth and elevation angles of the satellite antenna set.

2. Description of the Related Art

A satellite antenna mechanism typically includes a signal receiver device and an orientation adjusting apparatus for adjusting and fine tuning the azimuth and elevation angles of a satellite antenna set. During adjustment, lock bolt units are loosened to allow for manual adjustment of the orientation of the satellite antenna set relative to a base. The lock bolt units are tightened after adjustment so as to lock down the orientation of the satellite antenna set. However, manual adjustment is troublesome, and makes it difficult to accurately adjust the orientation of the satellite antenna set.

SUMMARY OF THE INVENTION

The object of this invention is to provide an orientation adjusting apparatus for a satellite antenna set, which can easily and accurately adjust the orientation of the satellite antenna set.

According to this invention, an orientation adjusting apparatus includes a support base plate set, a support bracket disposed above the support base plate set for supporting a signal receiver device, an elevation bracket, an elevation fine tune bracket, and an azimuth bracket. The elevation bracket, the elevation fine tune bracket, and the azimuth bracket are disposed between the support base plate set and the support bracket. The top plate is rotatable relative to the mast clamp about a first vertical axis. The support base plate set is rotatable relative to the mast about a first vertical axis. The azimuth bracket is rotatable relative to the support base plate set about a second vertical axis. The support bracket is connected with the elevation bracket. The elevation bracket is rotatable relative to the elevation fine tune bracket about a first horizontal axis. The elevation fine tune bracket is rotatable relative to the azimuth bracket about a second horizontal axis. An azimuth angle fine tuning unit is operable to rotate the azimuth bracket relative to a top plate of the support base plate set about the second vertical axis. An elevation angle fine tuning unit is operable to rotate the elevation fine tune bracket relative to the azimuth bracket about the second horizontal axis.

The azimuth angle fine tuning unit includes a first stud, a first positioning element connected rotatably to the first stud such that relative axial movement between the first positioning element and the first stud is prevented, and a first nut engaging the first stud. The first stud can be rotated within the first nut so as to adjust the azimuth angle of the satellite antenna set.

The elevation angle fine tuning unit includes a second stud, a second positioning element connected rotatably to second stud, and a second nut engaging the second stud. The second stud can be rotated within the second nut so as to adjust the elevation angle of the satellite antenna set.

Preferably, each of the first and second studs is provided with a rotary lever. Therefore, the first and second studs can be easily operated to adjust the orientation of the satellite antenna set.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
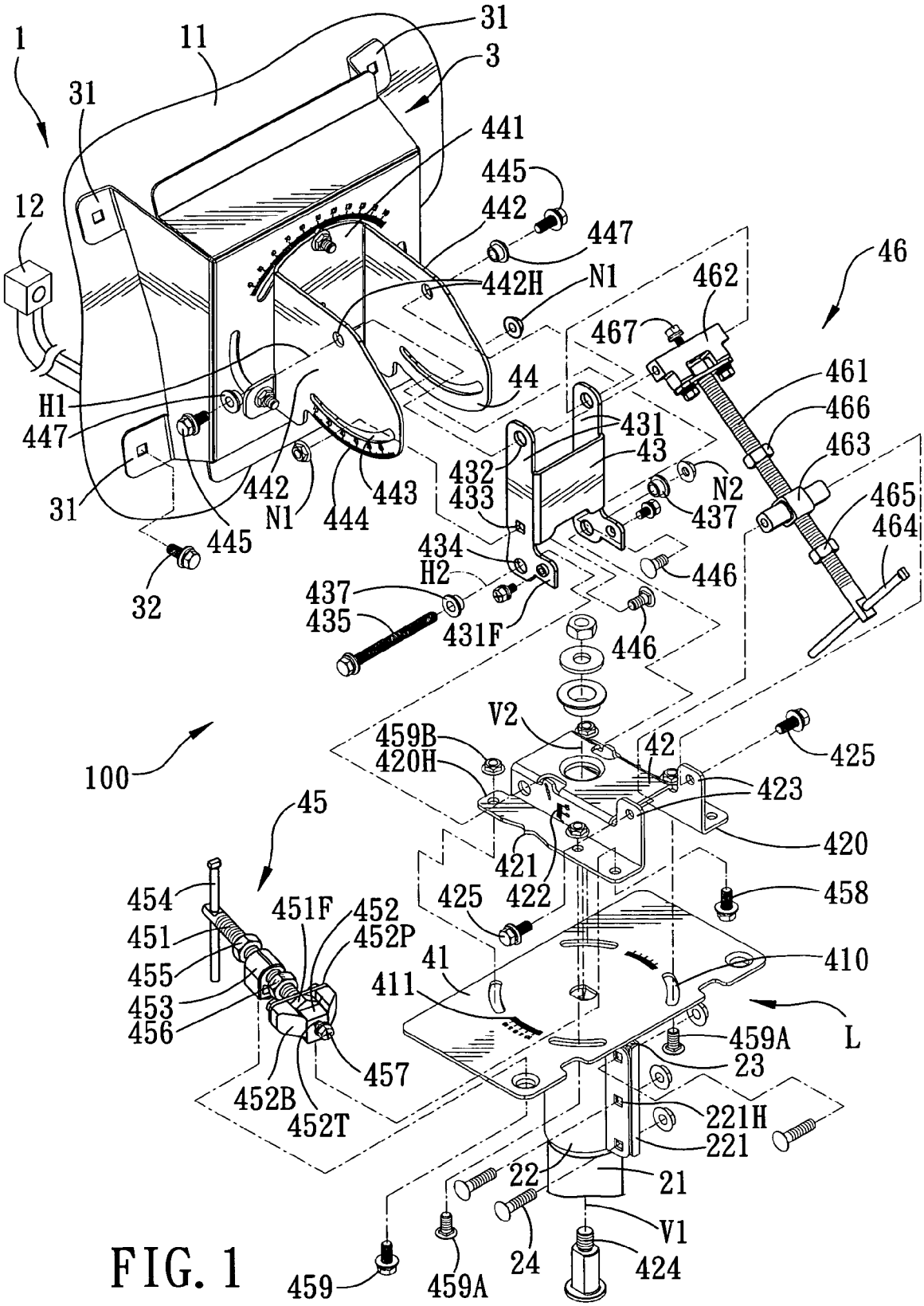
FIG. 1 is a partly exploded perspective view of the preferred embodiment of an orientation adjusting apparatus according to this invention, which is applied to a satellite antenna set.
Figure 2:
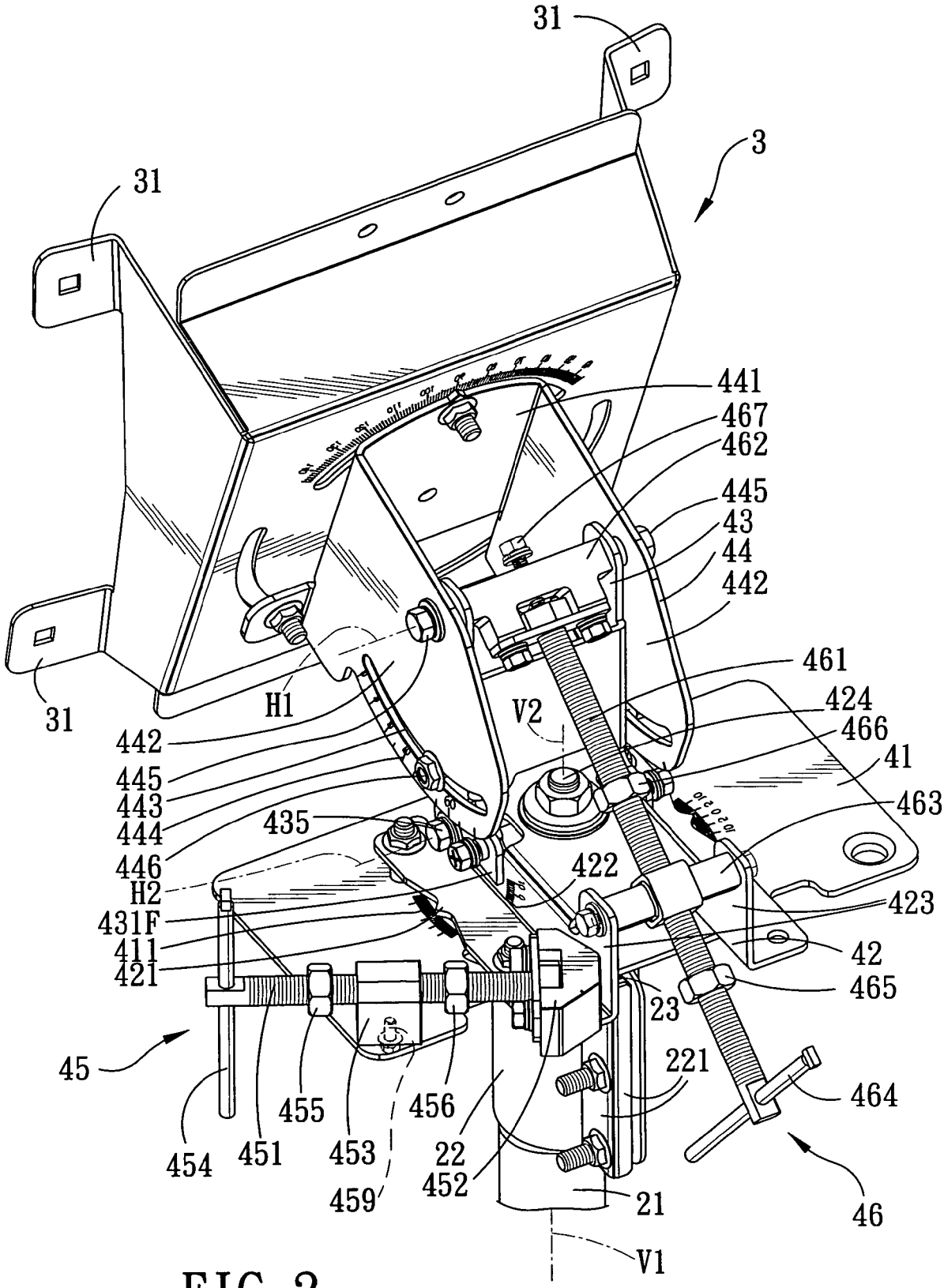
FIG. 2 is an assembled perspective view of the preferred embodiment.

Referring to FIGS. 1, 2, 3, and 4, the preferred embodiment of an orientation adjusting apparatus according to this invention is applied to a satellite antenna set 100 that includes a signal receiver device 1. The signal receiver device 1 is provided with a reflector 11 and a LNBF (low noise block with integrated feed) 12.

The orientation adjusting apparatus includes a mast 21, a support base plate set (L), an azimuth bracket 42, an elevation fine tune bracket 43, an elevation bracket 44, a support bracket 3, an azimuth angle fine tuning unit 45, and an elevation angle fine tuning unit 46.

The support base plate set (L) is disposed on and above the mast 21, and is rotatable relative to the mast 21 about a first vertical axis (V1). The support base plate set (L) includes a mast clamp 22 and a top plate 41. The top plate 41 is connected fixedly to an upper end of the mast clamp 22, and is formed with four curved slide slots 410 (see FIG. 1). The mast clamp 22 is configured as a C-shaped clamp, and has an open-ended vertical slot 23, and two end flanges 221 with three pairs of aligned holes (221H). The first vertical axis (V1) extends through the center of the mast clamp 22. A horizontal lock bolt unit includes three horizontal lock bolts 24 extending respectively through the three pairs of the holes (221H) in the end flanges 221 of the mast clamp 22 so as to lock the mast clamp 22 on the mast 21.

The azimuth bracket 42 is disposed rotatably on and above the top plate 41 of the support base plate set (L), is rotatable relative to the support base plate set (L) about a second vertical axis (V2), and includes two aligned integral horizontal pointers 421, and two aligned elevation angle-indicating scales 422 indicated respectively on outer surfaces of two parallel walls 423 that are interconnected fixedly. A vertical shaft bolt unit 424 extends through the top plate 41 of the support base plate set (L) and the azimuth bracket 42 so as to allow for rotation of the azimuth bracket 42 relative to the support base plate set (L) about the vertical shaft bolt unit 424. The second vertical axis (V2) extends through the center of the vertical shaft bolt unit 424. The azimuth bracket 42 has two opposite horizontal plate portions 420 (see FIG. 1) that are formed with four holes (420H) (only two are shown in FIG. 1). Four vertical lock bolts (459A) (only two are shown in FIG. 1) extend respectively through the curved slide slots 410 in the top plate 41 and the holes (420H) in the azimuth bracket 42, and engage respectively four nuts (459B). Thus, the azimuth bracket 42 is locked on the top plate 41.

The top plate 41 of the support base plate set (L) has a top surface that is formed with two scales 411 which are aligned respectively with and which are adjacent respectively to the pointers 421 of the azimuth bracket 42, and which indicate the rotational angle of the azimuth bracket 42 relative to the top plate 41 of the support base plate set (L) about the second vertical axis (V2).

The azimuth angle fine tuning unit 45 includes a first stud 451, a first positioning element 452 connected rotatably to an inner end of the first stud 451 such that relative axial movement between the first positioning element 452 and the first nut 453 is prevented, a first nut 453 engaging an intermediate portion of the first stud 451, a first rotary lever 454 attached to an outer end of the first stud 451 and extending perpendicular to the first stud 451, two first stop nuts 455, 456 engaging the first stud 451 and located at opposite sides of the first nut 453, and a first adjustment bolt 457. Two vertical first pivot screw units 458 (see FIG. 3), 459 (see FIG. 2) are configured as headed lock bolts, extend respectively through the azimuth bracket 42 and the top plate 41, and engage respectively threaded holes (not shown) in the first positioning element 452 and the first nut 453. Therefore, rotation of the first rotary lever 454 will cause horizontal movement of the first positioning element 452 relative to the first nut 453 so as to result in rotation of the azimuth bracket 42 relative to the support base plate set (L) about the second vertical axis (V2).

The first positioning element 452 includes a retaining block (452B) (see FIG. 1) and a retaining plate (452P) (see FIG. 1). The retaining block (452B) has a U-shaped portion that defines a groove (452G) (see FIG. 3). The retaining plate (452P) is sleeved on the first stud 451, and is connected fixedly to the retaining block (452B) by two lock bolts (452L) (see FIG. 3). The inner end of the first stud 451 is formed with an outward flange (451F) (see FIG. 1) that extends radially and outwardly therefrom and that is confined within the groove (452G) in the retaining block (452B) of the first positioning block 452. The retaining block (452B) of the first positioning element 452 is formed with a threaded hole (452T) (see FIG. 1) communicated with the groove (452G) (see FIG. 3) and extending along an axial direction of the first stud 451. The first adjustment bolt 457 engages the threaded hole (452T) in the first positioning element 452, and has an end extending into the groove (452G) in the positioning element 452 so as to define a flange-receiving space that is disposed between the end of the first adjustment bolt 457 and the retaining plate (452P) and that is sized so as to prevent axial movement of the first positioning element 452 relative to the first stud 451. The elevation fine tune bracket 43 is disposed rotatably on and under the elevation bracket 44 so as to allow for rotation of the elevation bracket 44 relative to the elevation fine tune bracket 43 about a first horizontal axis (H1), and is disposed rotatably on and above the azimuth bracket 42 so as to allow for rotation of the elevation fine tune bracket 43 relative to the azimuth bracket 42 about a second horizontal axis (H2).

The satellite antenna set 1 is connected fixedly to the support bracket 3. The support bracket 3 has four corners, each of which is formed with a lug 31 that is fixed to the satellite antenna set 1 by a lock bolt 32. The elevation bracket 44 includes a fixed plate 441, two spaced-apart parallel vertical walls 442 that extend respectively, integrally, and perpendicularly from two opposite sides of the fixed plate 441 and that are formed with two aligned holes (442H) and two aligned curved guiding slots 443, which are disposed below the holes (442H) and which extend along circumferential directions of the holes (442H), respectively. The first horizontal axis (H1) extends through the centers of the holes (442H). Two scales 444 are indicated respectively on outer surfaces of the vertical walls 442 under the guiding slots 443 for indicating the rotational angle of the elevation bracket 44 relative to the elevation fine tune bracket 43 about the first horizontal axis (H1).

The elevation fine tune bracket 43 includes two spaced-apart parallel vertical walls 431 that are disposed fixedly thereon and that are located between the vertical walls 442 of the elevation bracket 44. Each of the vertical walls 431 has an upper hole 432, a middle hole 433 disposed under the upper hole 432, a lower hole 434 disposed under the middle hole 433, and a generally horizontal flange (431F) (see FIG. 1). The second horizontal axis (H2) extends through the centers of the lower holes 434.

The elevation angle fine tuning unit 46 is similar to the azimuth angle fine tuning unit 45 in construction, and includes a second stud 461, a second positioning element 462, a second nut 463, a second rotary lever 464, two second stop nuts 465, 466, and a second adjustment bolt 467. A pair of upper and lower horizontal second pivot screw units connect the second positioning element 462 and the second nut 463 respectively to the elevation fine tune bracket 43 and the azimuth bracket 42 so that rotation of the second stud 461 within the second nut 463 will cause movement of the second positioning element 462 relative to the second nut 463, thereby resulting in rotation of the elevation fine tune bracket 43 relative to the azimuth bracket 42 about the second horizontal axis (H2). The upper second pivot screw unit includes two headed short lock bolts 445 that extend respectively through the holes (442H) in the vertical walls 442 of the elevation bracket 44 and through the upper holes 432 in the vertical walls 431 of the elevation fine tune bracket 43 and that engage respectively threaded holes in two opposite side surfaces of the second positioning element 462. The lower second pivot screw unit includes two headed short lock bolts 425 that extend respectively through the vertical walls 423 of the azimuth bracket 42 and that engage respectively threaded holes in two opposite side surfaces of the second nut 463. Two bushings 447 (see FIG. 1) are disposed between the short lock bolts 445 and the vertical walls 442. The flanges (431F) of the elevation fine tune bracket 43 are aligned with and are adjacent to the elevation angle-indicating scales 422, and have planar bottom surfaces (431S) (see FIG. 4) for indicating the rotational angle of the elevation fine tune bracket 43 relative to the azimuth bracket 42 about the second horizontal axis (H2).

The elevation bracket 44 further includes two upper lock bolts 446 and two upper lock nuts (N1) (see FIG. 1). The upper lock bolts 446 extend through the guiding slots 443 in the vertical walls 442 of the elevation bracket 44 and the middle holes 433 in the vertical walls 431 of the elevation fine tune bracket 43. The upper lock nuts (N1) engage the upper lock bolts 446 respectively so as to lock the elevation bracket 44 relative to the elevation fine tune bracket 43. A lower long lock bolt 435 extends through the lower holes 434 in the vertical walls 431 of the elevation fine tune bracket 43 and the vertical walls 423 of the azimuth bracket 42, and engages a lower lock nut (N2) so as to lock the elevation fine tune bracket 43 relative to the azimuth bracket 42. Two bushings 437 are disposed between the lower long lock bolt 435 and the vertical walls 431 of the elevation fine tune bracket 43.

When it is desired to adjust roughly the azimuth angle of the satellite antenna set 1, the horizontal lock bolts 24 are loosened. Subsequently, the mast clamp 22 of the support base plate set (L) is rotated on the mast 21 in a known manner. The horizontal lock bolts 24 are tightened after adjustment.

Figure 3:
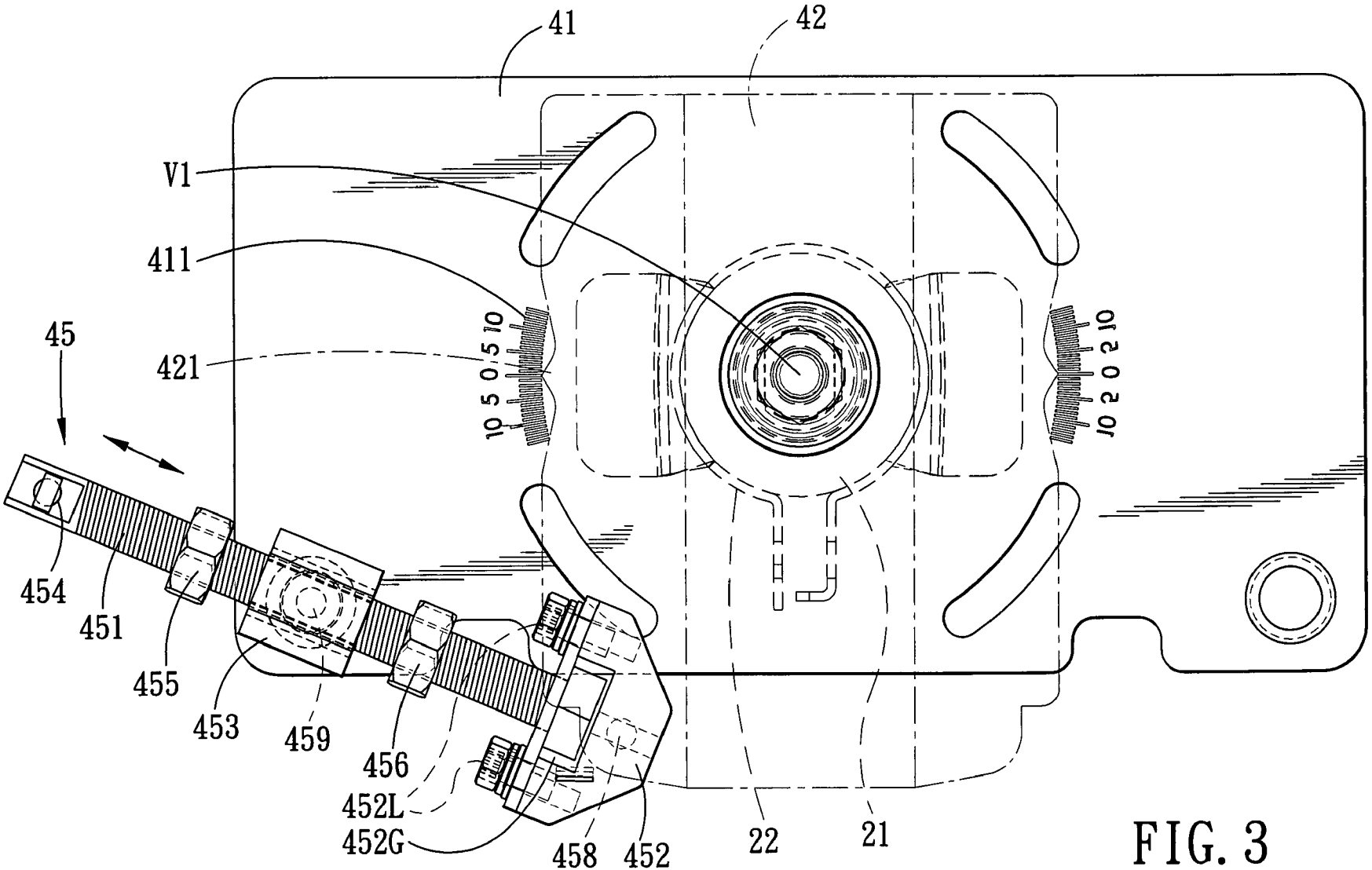
FIG. 3 is a schematic top view of the preferred embodiment, illustrating how the azimuth angle of the satellite antenna set is adjusted.

When it is desired to fine tune the azimuth angle of the satellite antenna set 1, the first pivot screw units 458, 459 and the vertical lock bolts (459A) are loosened. Subsequently, the first rotary lever 454 of the azimuth angle fine tuning unit 45 is operated to move the first positioning element 452 relative to the first nut 453 so as to rotate the azimuth bracket 42 relative to the top plate 41 of the support base plate set (L) about the second vertical axis (V2), as shown in FIG. 3. The first pivot screw units 458, 459 and the vertical lock bolts (459A) are tightened after adjustment.

When it is desired to adjust roughly the elevation angle of the satellite antenna set 1, the short lock bolts 445 and the upper lock bolts 446 are loosened. Subsequently, the elevation bracket 44 is rotated relative to the elevation fine tune bracket 43 in a known manner so as to adjust the elevation angle of the elevation bracket 44 relative to the elevation fine tune bracket 43. The short lock bolts 445 and the upper lock bolts 446 are tightened after adjustment.

Figure 4:
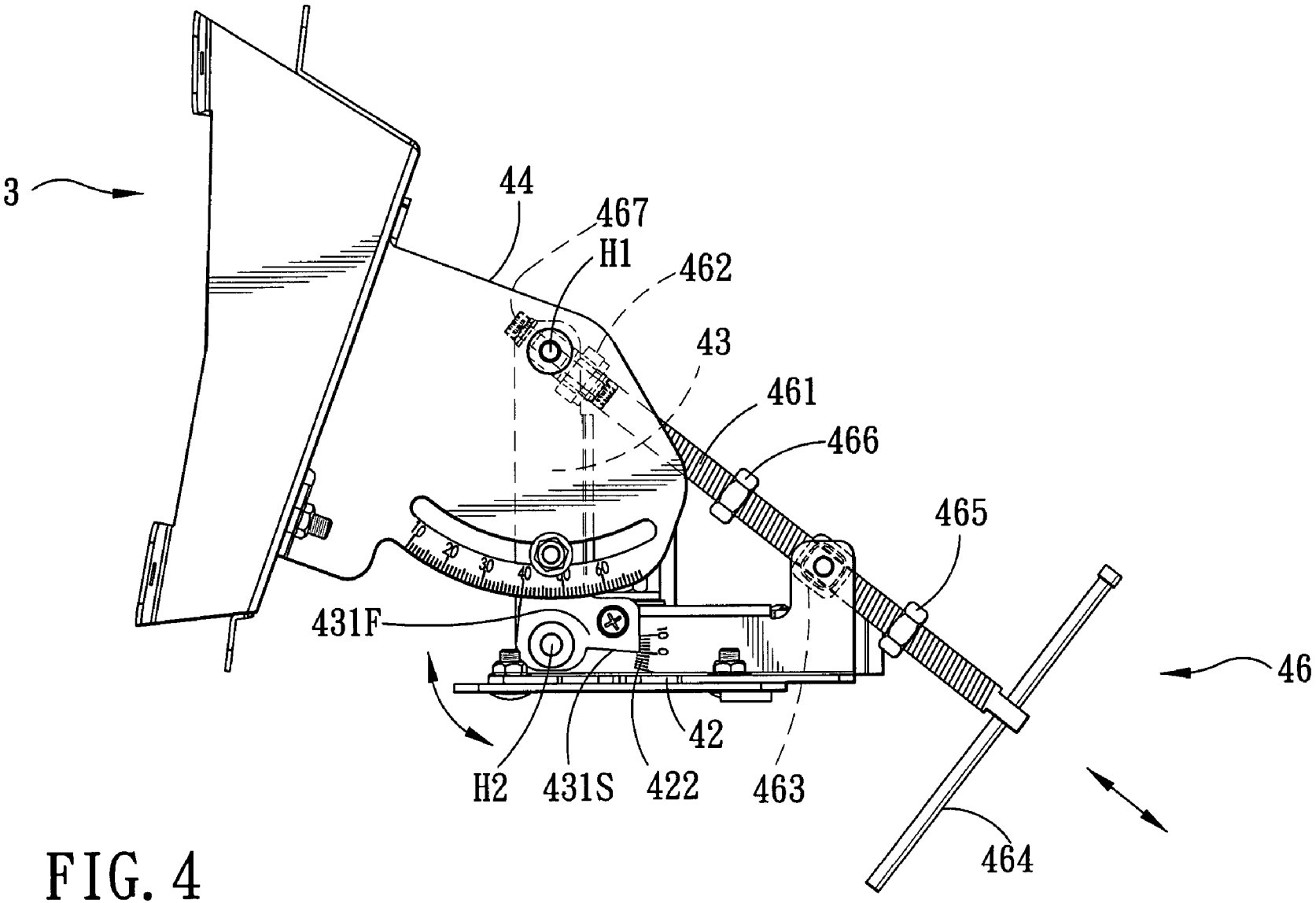
FIG. 4 is a schematic side view of the preferred embodiment, illustrating how the elevation angle of the satellite antenna set is adjusted.

When it is desired to fine tune the elevation angle of the satellite antenna set 1, the short lock bolts 445, 425 are loosened. Subsequently, the second rotary lever 464 of the elevation angle fine tuning unit 46 is operated to move the second positioning element 462 relative to the second nut 463 so as to rotate the elevation fine tune bracket 43 relative to the azimuth bracket 42 about the second horizontal axis (H2), as shown in FIG. 4. The short lock bolts 445, 425 are tightened after adjustment.

With this invention thus explained, it is apparent that numerous modifications and variations can be made without departing from the scope and spirit of this invention. It is therefore intended that this invention be limited only as indicated by the appended claims.

We claim:

1. An orientation adjusting apparatus comprising:

a mast;

a support base plate set disposed rotatably on and above said mast and rotatable relative to said mast about a first vertical axis;

an azimuth bracket disposed rotatably on and above said support base plate set and rotatable relative to said support base plate set about a second vertical axis;

an azimuth angle fine tuning unit including a first stud, a first positioning element connected rotatably to said first stud such that relative axial movement between said first positioning element and said first nut is prevented, said first stud engaging said first stud, and two vertical first pivot screw units, one of said first pivot screw units connecting said first positioning element rotatably to said azimuth bracket, the other of said first pivot screw units connecting said first nut rotatably to said support base plate set so that rotation of said first stud within said first nut will cause horizontal movement of said first positioning element relative to said first nut, thereby resulting in rotation of said azimuth bracket relative to said support base plate set about said second vertical axis;

an elevation fine tune bracket disposed rotatably on and above said azimuth bracket;

an elevation bracket disposed rotatably on and above said elevation fine tune bracket such that said elevation bracket is rotatable relative to said elevation fine tune bracket about a first horizontal axis, said elevation fine tune bracket being disposed rotatably on and above said azimuth bracket and rotatable relative to said azimuth bracket about a second horizontal axis; and an elevation angle fine tuning unit including a second stud, a second positioning element connected rotatably to second stud such that relative axial movement between said second positioning element and said second nut is prevented, said second stud engaging said second stud, and two horizontal second pivot screw units connecting said second nut and said second positioning element respectively and rotatably to said azimuth bracket and said elevation fine tune bracket so that rotation of said second stud within said second nut will cause movement of said second positioning element relative to said second nut, thereby resulting in rotation of said elevation fine tune bracket relative to said azimuth bracket about said second horizontal axis.

2. The orientation adjusting apparatus as claimed in claim 1, wherein said support base plate set includes:

a mast clamp sleeved rotatably on an upper end of said mast and configured as a C-shaped clamp having two end flanges that are formed with aligned holes, said first vertical axis extending through a center of said mast clamp;

a horizontal lock bolt unit extending through said holes in said end flanges of said mast clamp so as to lock said mast clamp on said mast;

a horizontal top plate connected fixedly to an upper end of said mast clamp; and a vertical shaft bolt unit extending through said top plate of said support base plate set and said azimuth bracket so as to allow for rotation of said azimuth bracket relative to said support base plate set about said vertical shift bolt unit, said second vertical axis extending through a center of said vertical shift bolt unit.

3. The orientation adjusting apparatus as claimed in claim 1, wherein said azimuth bracket is formed with an integral pointer, said top plate of said support base plate set having a top surface that is formed with a scale aligned with and adjacent to said pointer of said azimuth bracket, said scale indicating rotational angle of said azimuth bracket relative to said support base plate set about said second vertical axis.

4. The orientation adjusting apparatus as claimed in claim 1, wherein said first stud of said azimuth angle fine tuning unit has inner and outer ends that are opposite to each other, said first positioning element of said azimuth angle fine tuning unit being disposed at said inner end of said first stud and being connected rotatably to said azimuth bracket, said first nut of said azimuth angle fine tuning unit engaging an intermediate portion of said first stud and being connected rotatably to said top plate of said support base plate set, said first pivot screw units being configured as headed lock bolts that extend respectively through said azimuth bracket and said top plate of said support base plate set and that engage respectively and threadably said first positioning element and said first nut.

5. The orientation adjusting apparatus as claimed in claim 4, wherein said azimuth angle fine tuning unit further includes a first rotary lever that is attached to said outer end of said first stud and that extends perpendicular to said first stud.

6. The orientation adjusting apparatus as claimed in claim 4, wherein said azimuth angle fine tuning unit further includes two first stop nuts engaging said first stud and disposed at opposite sides of said first nut.

7. The orientation adjusting apparatus as claimed in claim 4, wherein each of said first and second positioning elements of said azimuth angle fine tuning unit and said elevation angle fine tuning unit includes:

a retaining block having a U-shaped portion that defines a groove; and a retaining plate sleeved rotatably on a corresponding one of said first and second studs and connected threadedly to said retaining block, said inner end of the corresponding one of said first and second studs being formed with an outward flange that extends radially and outwardly therefrom and that is confined within said groove in said retaining block by said retaining plate such that axial movement of each of said first and second positioning elements relative to the corresponding one of said first and second studs is prevented.

8. The orientation adjusting apparatus as claimed in claim 7, wherein said retaining block of said first positioning element of said azimuth angle fine tuning unit is formed with a threaded hole communicated with said groove and extending along an axial direction of said first stud, said azimuth angle fine tuning unit further including a first adjustment bolt that engages said threaded hole in said retaining block and that has an end which extends into said groove in said retaining block so as to define a flange-receiving space that is located between said end of said adjustment bolt and said retaining plate and that is sized so as to prevent axial movement of said first positioning element relative to said first stud.

9. The orientation adjusting apparatus as claimed in claim 1, wherein said elevation bracket includes two spaced-apart parallel vertical walls that are disposed fixedly thereon and that are formed with two aligned holes and two aligned curved guiding slots, which are disposed below said holes in said vertical walls of said elevation bracket and which extend respectively along circumferential directions of said holes in said vertical walls of said elevation bracket, said first horizontal axis extending through centers of said holes in said vertical walls of said elevation bracket;

said elevation fine tune bracket includes two spaced-apart parallel vertical walls that are disposed fixedly thereon and that are located between said vertical walls of said elevation bracket, each of said vertical walls of said elevation fine tune bracket having an upper hole, a lower hole, and a middle hole that is disposed under said upper hole and above said lower hole, said second horizontal axis extending through centers of said lower holes;

said second positioning element of said elevation angle fine tuning unit has two opposite side surfaces that are formed with two aligned threaded holes; and one of said second pivot screw units includes two short lock bolts that extend respectively through said holes in said vertical walls of said elevation bracket and through said upper holes in said vertical walls of said elevation fine tune bracket and that engage respectively said threaded holes in said second positioning element of said elevation angle fine tuning unit, said elevation bracket further including two upper lock bolts extending through said guiding slots in said vertical walls of said elevation bracket and said middle holes in said vertical walls of said elevation fine tune bracket, and two upper lock nuts engaging respectively said upper lock bolts so as to lock said elevation bracket relative to said elevation fine tune bracket, said elevation fine tune bracket further including a lower long lock bolt extending through said lower holes in said vertical walls of said elevation fine tune bracket and said azimuth bracket, and a lower lock nut engaging said lower long lock bolt.

10. An orientation adjusting apparatus comprising:

a mast;

a support base plate set disposed rotatably on and above said mast and rotatable relative to said mast about a first vertical axis;

an azimuth bracket disposed rotatably on and above a top plate of said support base plate set and rotatable relative to said top plate of said support base plate set about a second vertical axis; and an azimuth angle fine tuning unit including a stud, a positioning element connected rotatably to said stud such that relative axial movement between said positioning element and said stud is prevented, a nut engaging said stud, and two vertical pivot screw units, one of said pivot screw units connecting said positioning element rotatably to said azimuth bracket, the other of said pivot screw units connecting said nut rotatably to said top plate of said support base plate set so that rotation of said stud within said nut will cause horizontal movement of said positioning element relative to said nut, thereby resulting in rotation of said azimuth bracket relative to said top plate of said support base plate set about said second vertical axis.

11. The orientation adjusting apparatus as claimed in claim 10, wherein said support base plate set includes:

a mast clamp sleeved rotatably on an upper end of said mast and configured as a C-shaped clamp having two end flanges that are formed with aligned holes, said first vertical axis extending through a center of said mast clamp;

a horizontal lock bolt unit extending through said holes in said end flanges of said mast clamp so as to lock said mast clamp on said mast;

a horizontal top plate connected fixedly to an upper end of said mast clamp; and a vertical shaft bolt unit extending through said top plate of said support base plate set and said azimuth bracket so as to allow for rotation of said azimuth bracket relative to said top plate of said support base plate set about said vertical shaft bolt unit, said second vertical axis extending through a center of said vertical shaft bolt unit.

12. The orientation adjusting apparatus as claimed in claim 10, wherein said azimuth bracket is formed with an integral pointer, said top plate of said support base plate set having a top surface that is formed with a scale aligned with and adjacent to said pointer of said azimuth bracket, said scale indicating rotational angle of said azimuth bracket relative to said top plate of said support base plate set about said second vertical axis.

13. The orientation adjusting apparatus as claimed in claim 10, wherein said stud of said azimuth angle fine tuning unit has inner and outer ends that are opposite to each other, said positioning element of said azimuth angle fine tuning unit being disposed at said inner end of said stud and being connected rotatably to said azimuth bracket, said nut of said azimuth angle fine tuning unit engaging an intermediate portion of said stud and being connected rotatably to said top plate of said support base plate set, said pivot screw units being configured as headed lock bolts that extend respectively through said azimuth bracket and said top plate of said support base plate set and that engage respectively and threadably said positioning element and said nut.

14. The orientation adjusting apparatus as claimed in claim 13, wherein said azimuth angle fine tuning unit further includes a rotary lever that is attached to said outer end of said stud and that extends perpendicular to said stud.

15. The orientation adjusting apparatus as claimed in claim 13, wherein said azimuth angle fine tuning unit further includes two stop nuts engaging said stud and disposed at opposite sides of said nut.

16. The orientation adjusting apparatus as claimed in claim 13, wherein said positioning element of said azimuth angle fine tuning unit includes:

a retaining block having a U-shaped portion that defines a groove; and a retaining plate sleeved rotatably on said stud and connected threadedly to said retaining block, said inner end of said stud being formed with an outward flange that extends radially and outwardly therefrom and that is confined within said groove in said retaining block by said retaining plate such that axial movement of said positioning element relative to said nut is prevented.

17. The orientation adjusting apparatus as claimed in claim 16, wherein said retaining block of said positioning element of said azimuth angle fine tuning unit is formed with a threaded hole communicated with said groove and extending along an axial direction of said stud, said azimuth angle fine tuning unit further including an adjustment bolt that engages said threaded hole in said retaining block and that has an end which extends into said groove in said retaining block so as to define a flange-receiving space that is located between said end of said adjustment bolt and said retaining plate and that is sized so as to prevent axial movement of said positioning element relative to said nut.

18. An orientation adjusting apparatus comprising:

an azimuth bracket;

an elevation fine tune bracket disposed rotatably on and above said azimuth bracket;

an elevation bracket disposed rotatably on and above said elevation fine tune bracket such that said elevation bracket is rotatable relative to said elevation fine tune bracket about a first horizontal axis, said elevation fine tune bracket being disposed rotatably on and above said azimuth bracket and rotatable relative to said azimuth bracket about a second horizontal axis; and an elevation angle fine tuning unit including a stud, a positioning element connected rotatably to stud such that relative axial movement between said positioning element and said stud is prevented, a nut engaging said stud, and two horizontal pivot screw units connecting said nut and said positioning element respectively and rotatably to said azimuth bracket and said elevation fine tune bracket so that rotation of said stud within said nut will cause movement of said positioning element relative to said nut, thereby resulting in rotation of said elevation fine tune bracket relative to said azimuth bracket about said second horizontal axis.

19. The orientation adjusting apparatus as claimed in claim 18, further comprising a support base plate set, said azimuth bracket being disposed rotatably on and above said top plate of said support base plate set and being rotatable relative to said top plate of said support base plate set about a second vertical axis.

20. The orientation adjusting apparatus as claimed in claim 18, wherein said elevation bracket includes two spaced-apart parallel vertical walls that are disposed fixedly thereon and that are formed with two aligned holes and two aligned curved guiding slots, which are disposed below said holes in said vertical walls of said elevation bracket and which extend respectively along circumferential directions of said holes in said vertical walls of said elevation bracket, said first horizontal axis extending through centers of said holes in said vertical walls of said elevation bracket;

said elevation fine tune bracket includes two spaced-apart parallel vertical walls that are disposed fixedly thereon and that are located between said vertical walls of said elevation bracket, each of said vertical walls of said elevation fine tune bracket having an upper hole, a lower hole, and a middle hole that is disposed under said upper hole and above said lower hole, said second horizontal axis extending through centers of said lower holes;

said positioning element of said elevation angle fine tuning unit has two opposite side surfaces that are formed with two aligned threaded holes; and one of said pivot screw units includes two short lock bolts that extend respectively through said holes in said vertical walls of said elevation bracket and through said upper holes in said vertical walls of said elevation fine tune bracket and that engage respectively said threaded holes in said positioning element of said elevation angle fine tuning unit, said elevation bracket further including two upper lock bolts extending through said guiding slots in said vertical walls of said elevation bracket and said middle holes in said vertical walls of said elevation fine tune bracket, and two upper lock nuts engaging respectively said upper lock bolts so as to lock said elevation bracket relative to said elevation fine tune bracket, said elevation fine tune bracket further including a lower long lock bolt extending through said lower holes in said vertical walls of said elevation fine tune bracket and said azimuth bracket, and a lower lock nut engaging said lower long lock bolt.

* * * * *